United States Patent [19]

Trattner

[11] Patent Number: 4,823,241

[45] Date of Patent: Apr. 18, 1989

[54] PORTABLE SOLAR CHARGED OPERATED LAMP HAVING ORIENTATION SWITCH FOR SELECTIVELY ENERGIZING LAMP BASED UPON ITS PHYSICAL ORIENTATION

[75] Inventor: Burton Trattner, Ringwood, N.J.

[73] Assignee: Harvey-Westbury Corp., Westbury, N.Y.

[21] Appl. No.: 98,964

[22] Filed: Sep. 21, 1987

[51] Int. Cl.[4] ..... F21L 7/00

[52] U.S. Cl. ..... 362/183; 362/190; 362/155

[58] Field of Search ..... 362/94, 183, 189, 190, 362/191, 194, 199, 155

[56] References Cited

U.S. PATENT DOCUMENTS

| | | | |
|---|---|---|---|
| 1,287,393 | 12/1918 | Molnar | 362/200 |
| 2,156,463 | 5/1939 | Schulte | 362/94 |
| 2,705,750 | 4/1955 | Farnon | 362/155 |
| 2,712,058 | 6/1955 | Grebey | 362/199 |
| 3,612,853 | 12/1968 | Aoki | 362/191 |
| 4,441,143 | 4/1984 | Richardson, Jr. | 362/183 |

FOREIGN PATENT DOCUMENTS

| | | | |
|---|---|---|---|
| 3239489 | 4/1984 | Fed. Rep. of Germany | 362/183 |

*Primary Examiner*—Ira S. Lazarus
*Assistant Examiner*—Sue Hagarman
*Attorney, Agent, or Firm*—Louis Weinstein

[57] ABSTRACT

A portable lamp unit having adhesive strips for mounting upon the interior surface of a hatch back automobile window. A mercury switch permits the lamp to be lit only when the hatch back lid is open. A solar cell aligned with and receiving sunlight through the window charges the batteries. The lamp housing is swingably mounted and a detent enables the lamp to be retained in one of a number of different orientations to direct light to a selected region, and may be releasably locked in any one of a variety of positions to compensate for various open hatch angles to direct the focussed light rays upon the desired region of the storage space. A switch selectively opens the power loop to prevent unnecessary drainage of the batteries when the hatch back is opened for a long periods of time. A light transmissive adhesive may be utilized to mount the unit upon a window. Alternatively, a frame may be mounted to the window to snap fittingly releasably retain the lamp unit in position upon the hatch back window.

7 Claims, 3 Drawing Sheets

FIG.3
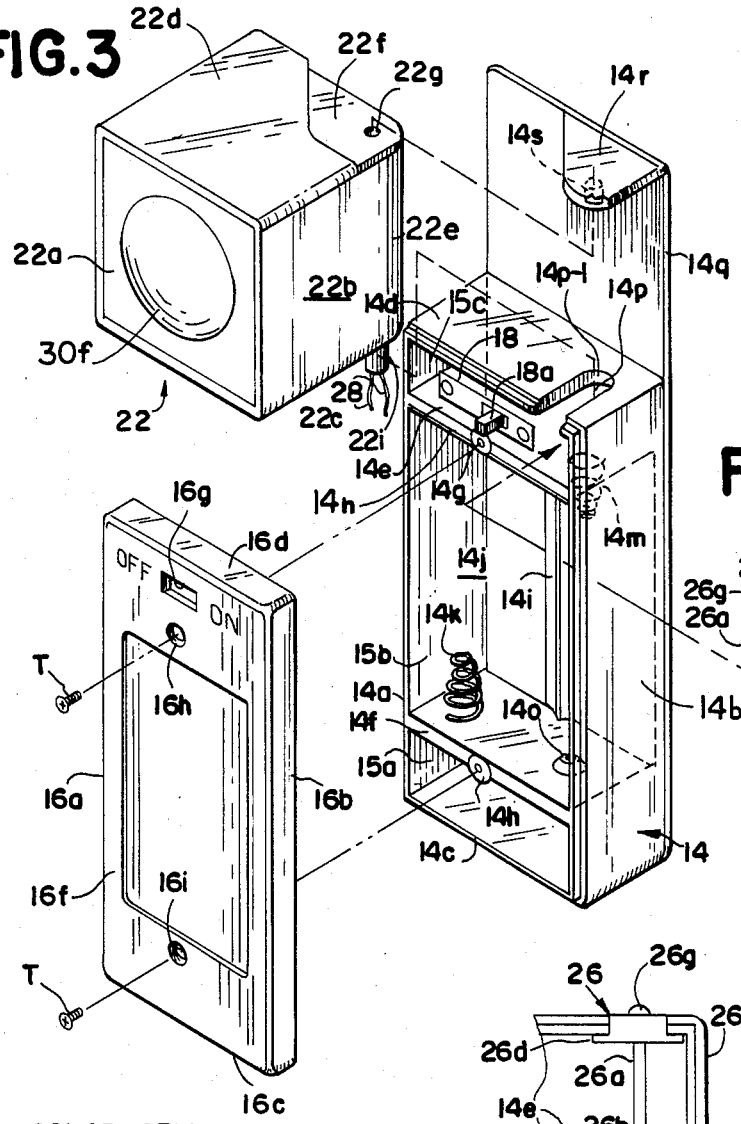
FIG. 4
FIG.6a
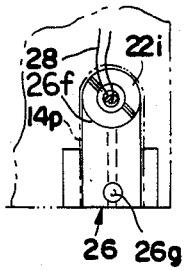
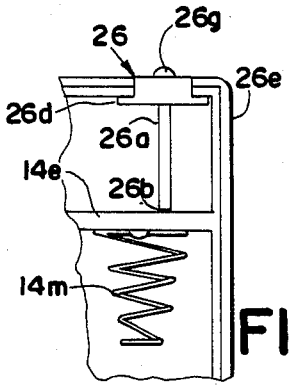
FIG. 6
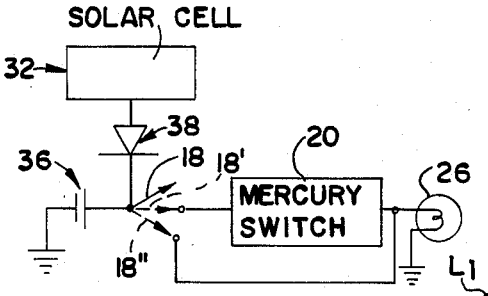
FIG. 7
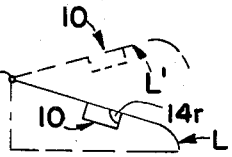
FIG. 7a

PORTABLE SOLAR CHARGED OPERATED LAMP HAVING ORIENTATION SWITCH FOR SELECTIVELY ENERGIZING LAMP BASED UPON ITS PHYSICAL ORIENTATION

FIELD OF THE INVENTION

The present invention relates to portable light units and more particular to a battery operated portable light unit rechargable by means of a solar cell and having an orientation-sensitive switch to permit energization of the lamp only when the unit is in a predetermined orientation.

BACKGROUND OF THE INVENTION

Automobile styles known as "hatch backs" typically are provided with a large rear door or "lid" which includes a rear window and which is utilized to gain access to the storage area provided in the rear portion of the vehicle interior. Hatch backs, like other trunk lids or closures are typically swingably mounted so as to lift or move in an upward direction enabling a person to reach beneath the open hatch back lid in order to remove or replace articles in the rear storage area of the vehicle. It is extremely advantageous to provide a lamp to provide adequate light when using the rear storage area at night. Many inexpensive hatch backs fail to provide interior lighting which is operable when the hatch back door is lifted to provide ample light in the rear storage region to facilitate use of the storage region at night or under other poor ambient lighting conditions.

Although the owners of inexpensive hatch back style automobiles may certainly wire such a lamp and switch into the hatch back, this becomes an extremely difficult and highly impractical undertaking due for the need for a large amount of wire, run from under the dashboard (most hatchbacks do not have 12 volts from the battery available in the rear of the automobile), a lamp assembly and switch means to permit the lamp to operate only when the hatch back door is open, as well as the tedious job of threading the wire through the vehicle and the hatch back lid.

In addition, the lamps made available in the trunks of many standard automobiles lack the ability to swingably adjust to direct light to any desired region in the trunk space when the trunk lid is lifted to the open position. Also, the lamps provided lack the capability of being used as a standby flashlight.

BRIEF DESCRIPTION OF THE INVENTION

The lamp unit of the present invention solves all of the problems of providing satisfactory illumination in hatch backs which are not provided with suitable lighting for illuminating the rear storage region of the vehicle and is characterized by comprising a housing which is provided with a light transmissive lens along one major surface thereof, which surface is substantially permanently affixed, through suitable pressure sensitive adhesive means, directly to the window of the hatch back lid. The solar cell is coupled in an electrical circuit with the portable battery source to charge the battery principally during periods of non-use, the light unit being judiciously located to take full advantage of available natural sunlight for recharging the batteries.

The lamp unit is further provided with an orientation sensitive switch such as, for example, a mercury switch, which provides an open circuit condition when the hatch back door is closed to prevent energy drain from the battery and possible burn-out of the bulb.

The lamp unit, although substantially permanently affixed to the hatch back window, is nevertheless provided with a pivot assembly including detent means for pivoting the lamp housing to a variety of different orientations to accomodate the variation in open hatchback angles of the hatchbacks available in the market. The lamp housing is releasably locked in the desired position by said detent means.

The solar cell provides for charging of the battery during periods of sunlight and includes an electrical circuit which prevents power from being delivered to the solar cell from the battery. Additional switch means are provided for disconnecting the lamp from the battery during periods when the hatch back lid is in the up position for long periods of time and yet when it is not desirable or necessary to provide light due to the fact that the hatch back may be in use as part of a tailgate party or when carrying bulky items which prevent locking of the hatch back lid.

The batteries are housed within a battery compartment and may be easily opened and replaced by replacement batteries. A snap-fitted cover incorporating a lens may be replacably removed for purposes of removing and replacing a burned out bulb.

The lamp unit may be fixedly secured to the hatch back window by means of a plurality a small pressure sensitive foam strips or alternatively, by means of a large transparent and decoratively printed pressure sensitive sheet which covers the entire rear surface of the lamp unit including the solar cell and its lens but which is made of a light transmissive material so as not to interfere with the ability of sunlight to activate the solar cell. The light transmissive material may also be reflective to provide additional safety when driving at night.

As another alternative arrangement, the lamp unit may be utilized in combination with a support frame which is directly secured to the window of the hatch back lid by suitable pressure sensitive means and which releasably embraces the lamp unit and is provided with a central opening which is coaligned with the solar cell lens to permit the sun's rays to reach the solar cell for charging of the battery. The unit may be removed and used as a standby flashlight. The electrical circuit incorporating the solar cell is adjusted to provide a low charging rate to the batteries so as to prevent overcharging and/or damage to the batteries.

The versatility of the lamp unit of the present invention also makes it extremely advantageous for use in the trunks of standard automobiles due to the ability to automatically adjust the lamp assembly to a variety of releasable orientations and removable from the holder unit for use as a standby flashlight.

OBJECTS OF THE INVENTION AND BRIEF DESCRIPTION OF THE FIGURES

It is therefore one object of the present invention to provide a novel lamp unit for use in applications where the lamp unit is preferably deenergized when in one physical orientation and which is capable of being energized only when moved to a second orientation.

Still another object of the present invention is to provide a lamp unit of the character described herein, wherein said selective energization is obtained through a position sensitive switch such as, for example, a mercury switch.

Still another object of the present invention is to provide a novel lamp unit adapted to be permanently fixed to a window or other light transmissive member to permit the portable batteries to be charged when the lamp unit is not in use.

Still another object of the present invention is to provide a novel lamp unit for use in illuminating the interior of a hatch back style vehicle or for use in the trunk of a standard vehicle (albeit forgoing the solar benefit) without the necessity for electrically wiring the lamp unit to the car main battery or electrical system.

Still another object of the present invention is to provide a novel battery-operated lamp unit which, although substantially permanently affixed to a mounting surface, is provided with a swingable lamp housing to direct the emitted light in any one of a variety of different directions to facilitate the use of the lamp unit in spite of it being permanently affixed to a mounting surface (and thereby compensating for various hatchback angles).

Still another object of the present invention is to provide a lamp unit of the character described herein wherein the mounting surface is preferably a light transmissive surface to facilitate charging of the battery source by way of the solar cell housed within the lamp unit.

Still another object of the present invention is to provide a portable battery operated lamp unit which is releaseably adjustable to one of a variety of orientations to accomodate a variety of open trunk lid positions in order to direct light to a desired area in the trunk storage space regardless of the angle of the open position of the trunk lid.

Still another object of the present invention is to provide a portable battery operated lamp unit which may be used as a trunk light and which is removable from a holding bracket for use as a standby flashlight.

The above as well as other objects of the present invention will become apparent when reading the accompanying description and drawing in which:

FIG. 3 shows the manner in which the lamp housing of the lamp unit of FIG. 1 may be pivoted.

Figure 4A:
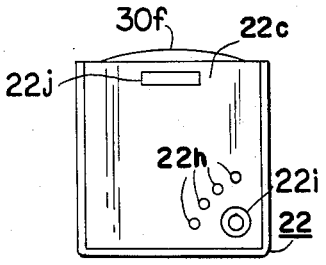
FIG. 4 shows an exploded view of the battery-operated lamp unit of FIG. 1.

FIG. 4*a* shows a bottom view of the lamp housing of FIG. 4.

Figure 5:
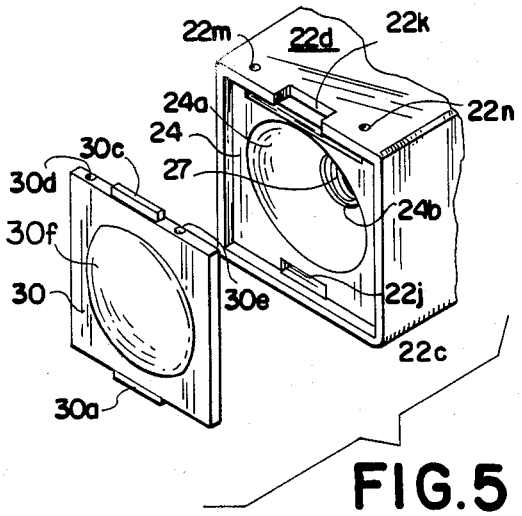

FIG. 5 is an exploded perspective view showing the details of the lamp housing structure of FIG. 4.

FIG. 6 shows a detailed elevation view of a portion of the lamp unit housing for purposes of facilitating an understanding of the pivot and detent assembly for pivotally mounting the lamp housing assembly.

FIG. 6*a* shows a top plan view of the assembly of FIG. 6.

Figure 1:
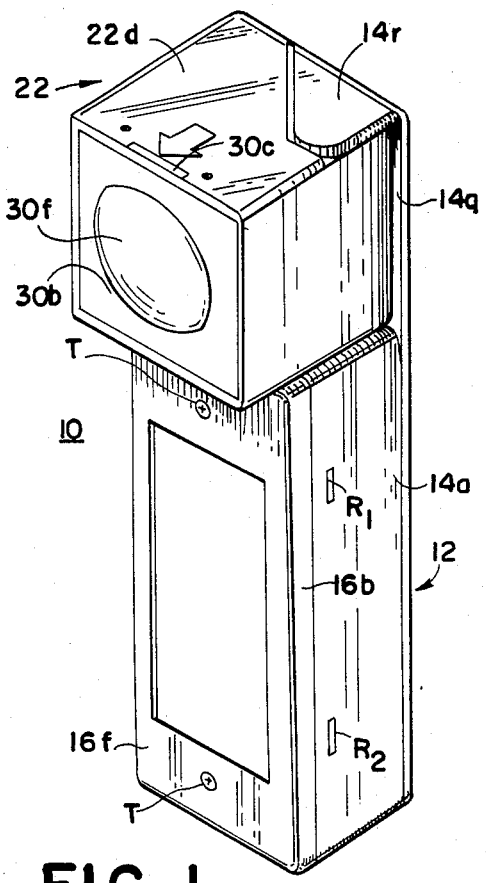
FIG. 1 is a perspective view showing a lamp unit embodying the principles of the present invention.
Figure 2:
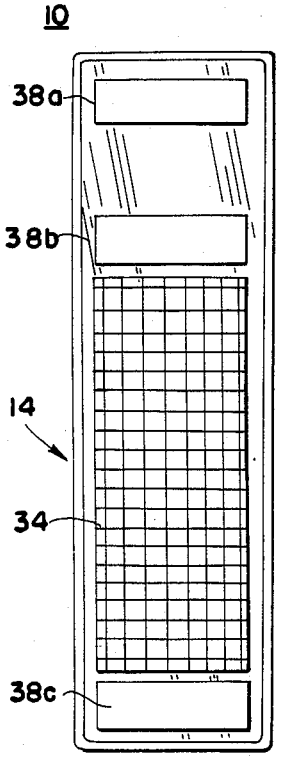
FIG. 2 is a rear elevational view of the lamp unit of FIG. 1.

FIG. 7 is a simplified circuit diagram of the electrical circuit provided in the lamp unit of FIG. 1.

FIG. 7*a* is a simplified diagramatic view useful in explaining the electrical operation of the lamp unit shown in FIGS. 4 and 7 and specifically the mercury switch.

Figure 7B:
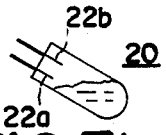
Figure 7C:
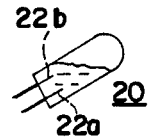

FIGS. 7*b* and 7*c* respectively show the mercury switch orientations when the lid is open and closed.

Figure 8:
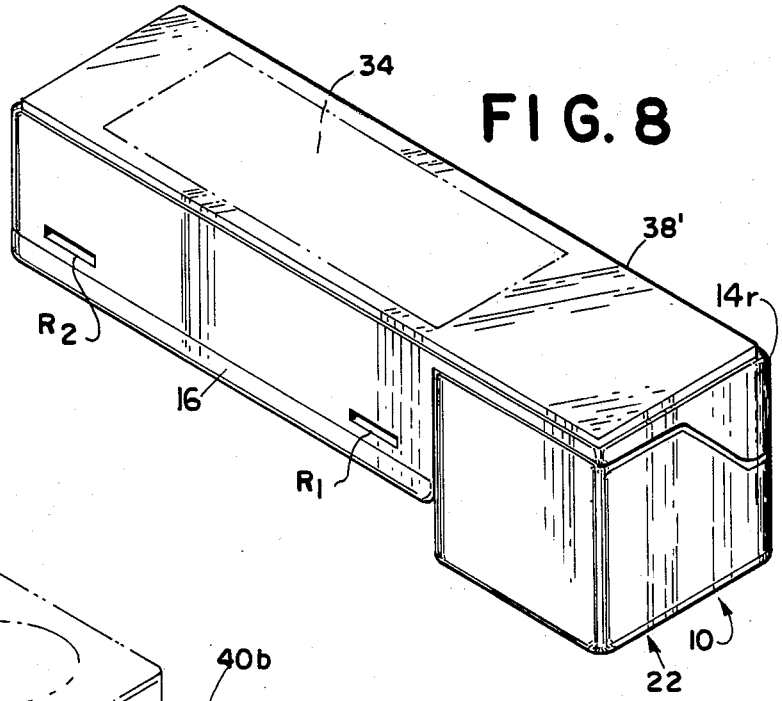

FIG. 8 is a perspective view showing the lamp unit of the present invention employing an alternative mounting assembly for mounting the lamp unit to a vehicle.

Figure 9:
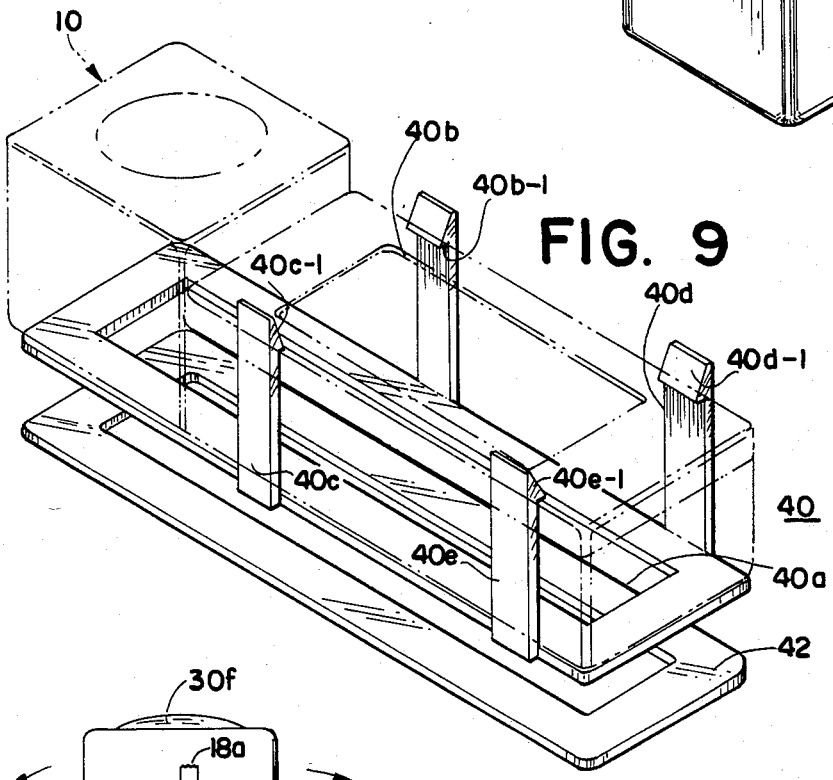

FIG. 9 is a perspective view showing another alternative mounting arrangement of the present invention.

Figure 9A:
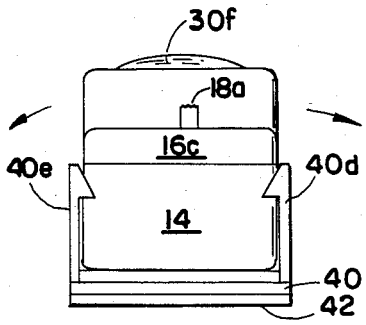

FIG. 9*a* shows an end view of the embodiment of FIG. 9.

DETAILED DESCRIPTION OF THE INVENTION AND THE PREFERRED EMBODIMENTS THEREOF

The lamp unit 10 of the present invention, as shown best in FIGS. 1 through 4, is comprised of a main body 12 including a main body portion 14 and a removable cover 16. The main body portion 14 is a substantially hollow parallelipiped whose vertical side walls 14*a*, 14*b* and top and bottom walls 14*d* and 14*c* define the hollow region which is further divided into three compartments 15*a*, 15*b* and 15*c* by integral dividing walls 14*e* and 14*f*. Partitions 14*e* and 14*f* are each provided with bosses 14*g*, 14*h* for receiving a threaded fastening member T, each threaded fastening member passing through a cooperating clearance opening 16, 16*i* aligned with the bosses 14*g*, 14*h* when the cover 16 is mounted to the housing 14.

Compartment 15*a* is not used. However, compartment 15*b* defines the battery compartment which, in the preferred embodiment, receives two type AA 1.5 volt alkaline batteries. The battery compartment is divided into a pair of elongated compartment halves by an elongated, pyramid-shaped divider 14*i* integrally joined to the base 14*j* of the battery compartment 15*b*. Each of the helical springs 14*k*, 14*m*, together with a fixed rigid electrode 14*n*, 14*o* respectively as well as additional electrical conductors (not shown for purposes of simplicity) establish an electrical circuit for the alkaline batteries which electrical circuit is shown in FIG. 7 and will described in greater detail hereinabove.

Compartment 15*c* houses two-position slide switch 18 and a two-position mercury switch 20 (see FIG. 7). Switch 18 is a two position switch having a slider member 18*a* which extends through elongated slot 16*g* in cover 16, the cover being marked with indicia to indicate the "on" and "off" positions of the slide switch.

Lid 16 has a major surface 16*f* provided with integral sides 16*a*–16*d* extending therefrom in a perpendicular direction. Sides 16*a*–16*d* are respectively aligned with associated sides 14*a*–14*d* of main housing 14 when lid 16 is mounted thereon. Slot 16*g* provided in main surface 16*f* facilitates the projection of the slide button 18*a* of slide switch 18 therethrough. Also, indicia "off" "on" are provided on the face of surface 16*f* to facilitate operation of slide switch 18. Openings 16*h* and 16*i* receive threaded fasteners T, T for securement of lid 16 to main housing 14. Lid 16 serves to cover compartments 15*a*–15*c* thereby retaining switches 18 and 20 and the individual batteries in their desired positions within compartments 15*b*, 15*c*.

The top wall 14*d* of housing unit 14 is provided with an elongated slot 14*p* which receives a combined pivot and detent member for swingably mounting lamp housing 22 upon the housing 14, as will be more fully described hereinbelow. The housing 14 further incorporates an integral upwardly extending planar projection 14*q* having an inwardly turned portion 14*r* provided with a downwardly extending projecting pin 14*s* serving as one pivot for the lamp housing 22.

Lamp housing 22 is a substantially square-shaped hollow housing comprised of vertical side walls 22a, 22b bottom wall 22c, top wall 22d and rear wall 22e collectively enclose a reflector member 24 which receives a bulb 26 which may, for example, be a number 222 (2.5 volt) threaded base bulb. Top surface 22d is provided with a substantially a trapezoidal-shaped recessed surface 22f having an opening 22g extending into housing 22d, which is adapted to receive projecting pin 14s serving as the upper pivot member for the pivotal mounting of lamp housing 22. Bottom wall 22c of lamp housing 22 (note also FIG. 4a) is provided with a plurality of either recesses or openings 22h arranged at spaced intervals along an imaginary curved line and cooperating with a detent member 26 in a manner to be more fully described. A hollow tubular-shaped projection 22i is integral with bottom wall 22c and extends downwardly in the manner shown in FIG. 4.

In order to mount lamp housing 22 in the operative position as shown in FIG. 1, flange 14r is lifted slightly and housing 22 is slid rearwardly into the region between top wall 14d and flange 14r so that tubular projection 22i is slipped into elongated slot 14p and extends into compartment 15c.

When the outer surface of the rear wall 22e of lamp housing 22 rests against the adjacent surface of planar portion 14q, the combined detent and pivot member 26 is slidably inserted into slot 14p and compartment 15c so that the lower end 26b of projection 26a rests against the top surface of partion 14e. The main body portion 26c of combined pivot and detent member 26 has a width slightly less than the width of elongated slot 14d to be slidably received therein. Projections 26d, 26e extend outwardly from main body portion 26c to form shoulders on opposite sides thereof which embrace the adjacent edges of elongated slot 14p to prevent member 26 from being moved vertically upward through slot 14p.

The rear end of main body portion 26c is provided with a semi-circular-shaped surface 26f which extends substantially half way around the tubular-shaped projection 22i extending downwardly from lamp housing 22. The semi-circular-shaped groove 26f cooperates with the semi-circular-shaped inner end of 14p-1 of elongated slot 14p to form a pivot for slidably embracing tubular projection 22i. The embracing slot and the projection 14x are aligned on a common longitudinal axis, as are opening 22g and tubular rejection 22i, to provide proper alignment for the lamp housing as well as providing a pivotal mount therefore.

The top surface of member 26 is provided with a teat 26g which is snapped fittingly received within one of the openings 22h provided along the bottom surface of lamp housing wall 22c, thus serving as a detent for locking the swingably mounted lamp housing into any one of a variety of angular positions selectable by the operator.

The lamp housing 22 is a hollow housing provided with a lamp socket 27 mechanically secured within the housing interior and provided with a pair of electrical leads 28 extending through tubular projection 22i for connection into the electrical circuit shown, for example, in FIG. 7. A reflector member 24 is positioned within the forward end of lamp housing 22 and has a conical-shaped reflector surface 24a with an opening 24b at its far end, which opening is aligned with bulb socket 27. Light bulb 26 extends through opening 24b in the reflector and is threaded into bulb socket 27. Housing lower wall 22c is provided with a slot 22j for receiving lower projection 30a provided along the bottom edge of combined lamp housing cover and lens member 30. Projection 30a is recessed inwardly from the front face 30b of member 30 so as to be aligned with slot 22j. An upper projection 30c is adapted to fit within square-shaped notch 22k provided at the front edge of upper wall 22d of housing unit 22. Member 30 is assembled by tilting the member 30 in order to insert projection 30 into slot 22g. Thereafter, the upper edge of member 30 is pushed into the lamp housing 22 with projection 30c aligned with square-shaped notch 22k. The upper edge of lens member 30 is provided with a pair of teats 30d, 30e which are snapped fittingly received within openings 22m, 22n in top wall 22d to retain lens 30 in position. To remove lens 30 one need simply place a fingernail or other sharp instrument behind projection 30c and pull the lens structure outwardly.

Lens member 30 is preferably formed of a unitary piece of suitable transparent plastic material into which a planoconvex lens is preferably molded, the convex surface of lens portion 30f being on the external side of member 30. Alternatively, the reflector 24 may serve as the primary optical focussing element. The right rear edge 22p which defines the merger or vertex between sides 22b and 22e (see FIG. 4a) is rounded to facilitate the pivotal motion of the housing 22 when assembled within housing 14.

The rear portion of housing 14 has an interior partition 14j as shown in FIGS. 1a and 4 to define an elongated vertically aligned hollow compartment 15d for housing solar cell 32 (see FIG. 7). The rear wall of housing 14 is provided with a light transmissive, lenticulated lens structure 34 which is coaligned with the solar cell positioned within compartment 15d to facilitate the free transmission of light rays therethrough to charge the alkaline batteries represented by the battery symbol 36 shown in FIG. 7.

A plurality of pressure sensitive adhesive strips 38a–38c formed of a foam material are arranged across portions of the rear surface of housing 14. Strips 38a–38c are preferably double-sided adhesive strips which are adhered on one surface thereof to the rear wall of housing unit 14 and are covered with thin protective strips which are peeled away upon application of the lamp unit to the window of a hatch back lid. The foam material compensates for the curvature of the glass window of the hatchback and assures good adhesive contact to both the curved glass surface and the flat rear surface of the lamp unit 10. Considering, for example, the simplified diagram shown in FIG. 7a, unit 10 is mounted upon the window of a hatch back lid L hingedly connected at its upper end L1 in such a manner that the surface of lens 34 is placed against the interior surface of the window in hatch back lid L and further so that the hinge portion 14r extends downwardly and with the longitudinal length of the lamp unit being aligned substantially horizontally.

Considering this orientation and the electrical circuit shown in FIG. 7, when slide switch 18 is closed i.e. moved to the dotted position 18', an electrical circuit is established between battery source 36 and mercury switch 20. However, the orientation of mercury switch 20 is such that its electrodes 22a, 22b are open circuited due to the mercury 22c being arranged in the portion of envelope 22d which is remote from electrodes 22a and 22b. Thus, when the hatch back lid is in a closed position shown in solid line fashion in FIG. 7*a*, bulb 26 is electrically isolated from power source 36.

When the hatch back lid is open, i.e. is lifted to the dotted line position L′ shown in FIG. 7*a*, the mercury switch 20 shifts from the position shown in FIG. 7*b* to the position shown in FIG. 7*c* causing electrodes 22*a*, 22*b* to be immersed in the liquid mercury thereby establishing an electrical circuit extending from battery 36 through closed switch 18 and mercury switch 20 to bulb 26.

In the event that it is desired to hold the hatch back lid in the open position for long periods of time, such as, for example, during a tail gate party or when transporting bulky objects which make it impossible to move lid L to its normally closed position, switch 18 may be opened to prevent energization of lamp 20 thereby prematurely draining the battery source 36 of energy.

Solar cell 32 is exposed to sunlight during the daylight hours, having been mounted upon the window of hatch back L to slowly charge batteries 36 through diode 38. The solar cell 36 and diode 38 are selected to provide a slow charging rate for the battery source (preferably alkaline batteries) so as to prevent the batteries from being overcharged and thereby damaged. Diode 38 prevents battery source 36 from directing energy back to solar cell 32, thereby protecting the batteries from discharging through the solar cell under darkened conditions.

Under normal operating conditions, switch 18 remains in the closed position 18′. The bulb 26 remains isolated from the power source due to the orientation of the lamp unit on the window of the hatch back lid L. The orientation sensitivity (i.e. mercury) switch 20 thus permits 26 to be energized only when the hatch back is opened.

In the charging circuit, in addition to being chosen to charge the battery source at a low charging rate, the solar cell is only active during daylight hours and is not active on a constant basis thus serving as additional protection against the potential overcharging of the alkaline cells.

The individual pressure sensitive adhesive strips 38*a* through 38*c* may be replaced by a single large double-sided pressure sensitive adhesive sheet 38′ shown in FIG. 8 wherein the under surface is in adhesive contact with the entire rear surface of housing 14, including lenticulated lens 34. The exposed surface of sheet 38 is likewise coated with a suitable adhesive for adhering to the window of the hatch back lid. The transparent or light transmissive sheet is preferably formed of a suitable light transmissive material as are the adhesive materials or alternatively, the adhesive materials are of a layer sufficiently thin so as to provide good light transmissive properties. The sheet is preferably a foam material to follow the curvature of the galss. The alternative embodiment in FIG. 8 provides significantly increased adhesive surface area to enhance the securment of the lamp unit 10 to the hatch back window. In addition, the adhesive strip may be provided with a reflective surface to provide additional reflective element to further facilitate the distinguishing of a vehicle when light from the head lamps of oncoming car strike the reflective surface.

A transparent sheet can be placed across and adhered to the entire rear surface of the lamp unit. Foam double-sided adhesive tapes are used around the perimeter of the rear surface to affix the lamp unit to the perimeter of the rear surface to affix the lamp unit to the curved glass surface. The transparent sheet may be marked with indicia such as a company logo, instructions or advertising. The transparent sheet may also be provided with a relective surface for added safety.

FIGS. 9 and 9*a* show still another alternative embodiment of the present invention in which the lamp unit 10 is mounted to the window of the hatch back lid by means of a holding frame 40 having a frame shaped body preferably provided with a large central opening 40*a* and at least two pairs of embracing arms 40*b*–40*c* and 40*d*–40*e*. The arms 40*b*–40*e* are resilient and bendable and are provided with rounded projections 40*b*-1 through 40*e*-1 near their upper inner ends to facilitate insertion of the light unit into the holder. The frame is further provided with a frame-like strip of double-sided pressure sensitive adhesive 42, one surface of which adheres to frame 40 and the other of which adheres to the window of the hatch back lid.

In order to snap fittingly mount the lamp unit to the holding frame, the lamp unit housing 14 is preferably provided with a pair of shallow recesses R1 and R2 arranged at spaced intervals along each of the opposing surfaces 14*a*, 14*b* of housing 14. Lamp unit 10, shown in dotted fashion in FIG. 9, is pressed between the pairs of embracing arms 40*b*–40*c* and 40*d*–40*e*. As unit 10 is pushed between the cooperating arms, the arms are flexed outwardly as shown by the arrows shown in FIG. 9*a* until the projections 40*b*-1 through 40*e*-1 are lined up with the shallow recesses R1 and R2 arranged in each side wall of housing 14, at which time the rounded projections 40*b*-1 through 40*e*-1 snap into an associated recess R1 or R2 to hold the lamp unit 10 in position. The arms 40*b*–40*e* provide sufficient spring forces to retain the lamp unit in the operative position. The lamp unit may be removed by simply by pulling at least two of the arms on one side of lamp unit away from the lamp unit to remove their projections from cooperating recesses and simply sliding the lamp unit out of the operative position. The lamp unit may be utilized as a portable lamp or "flash light" keeping in mind that the lamp unit switch 18 must be closed and further that the lamp unit must be oriented at a angle which assures that the mercury switch 20 is closed. The lamp unit of FIGS. 9 and 9*a* is otherwise substantially the same in design and operation to the lamp unit shown in FIGS. 1 and 2, for example. Alternatively, the lamp unit may be provided with a three-way switch as shown, whereby in the switch position 18″ the mercury switch is bypassed, enabling use of the lamp unit regardless of the orientation of the lamp unit (i.e. of the mercury switch).

It can be seen from the foregoing that the present invention provides a novel lamp unit structure which automatically selectively energizes the battery operated lamp unit when oriented at the proper angle, said lamp unit being substantially permanently affixed to the window of a hatch back lid thus, providing a lamp unit which is as effective as fully wired lamp units provided in more expensive hatch back vehicles while totally avoiding the need for wiring such lamp units, thereby providing hatch back vehicles with the equivalent lighting capabilities of more expensive hatch back models without providing the necessary wiring and cooperating electrical switches. In addition thereto, the present invention provides an additional switch which permits the hatch back to remain open for long periods of time without undue drain on the battery and in the flashlight mode, bypasses the mercury switch. The bypass position may be either part of a three-way switch, as shown, or may be a separate two-position (i.e. on/off) switch for selectively shunting the mercury switch. For example, more expensive hatch back units simply provide a proximity type switch which causes the hatch back lamp to be illuminated when the hatch back lid is open but fails to provide any means for turning the hatch back lamp off when the hatch back lid is deliberately left open for long periods of time. In addition the fully wired hatch back lamp provides an additional drain upon the vehicle 12 volt battery, while the present invention provides its own battery source which is further rechargable through the use of the uniquely arranged solar cell. The unit may alternatively be utilized as both a hatch back lamp and auxiliary "flash light" through the use of the novel holding frame which is substantially permanently affixed to the hatch back window. The adhesive strips utilized to substantially permanently secure the lamp unit to the hatch back window may further be provided with reflective means to provide an additional reflective surface for warning oncoming cars of the presence of the vehicle in the roadway.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A lamp unit comprising a hollow housing;

a battery compartment in said housing containing a portable battery source;

a lamp compartment in said housing and orientation sensitive switch means for selectively electrically coupling said lamp to said battery source when said housing is in a first orientation and for electrically decoupling said lamp from said battery source when said housing is in a second orientation;

means for substantially permanently affixing said housing to a normally movable lid member such as a chest, truck or hatchback lid adapted as a closure for a storage region;

said housing being affixed to the interior surface of said lid whereby said orientation sensitive switch is in the open position when the lid is in its closed position and whereby the orientation sensitive switch is in the closed position when said lid is in its open position;

said housing being provided with a solar cell compartment housing a solar cell;

said housing having a light transmissive lens portion to permit light rays to reach said solar cell;

said solar cell being electrically connected to said battery source when said solar cell is energized by light rays;

said lid being provided with a light transmissive member or window;

said lens portion of said housing being positioned to engage the interior surface of said window to facilitate the passage of light through said window and said lens to activate said solar cell, typically during daylight hours.

2. A lamp unit comprising a hollow housing;

a battery compartment in said housing containing a portable battery source;

a lamp compartment in said housing and orientation sensitive switch means for selectively electrically coupling said lamp to said battery source when said housing is in a first orientation and for electrically decoupling said lamp from said battery source when said housing is in a second orientation;

means for substantially permanently affixing said housing to a normally movable lid member such as a chest, truck or hatchback lid adapted as a closure for a storage region;

said housing being affixed to the interior surface of said lid whereby said orientation sensitive switch is in the open position when the lid is in its closed position and whereby the orientation sensitive switch is in the closed position when said lid is in its open position;

a lamp housing;

pivot means on said hollow housing for pivotally mounting said lamp housing to enable swingable movement of said lamp housing to direct light from said lamp in any one of a variety of desired directions;

said pivot means comprising a slot in said hollow housing;

a substantially L-shaped projection integral with and extending upwardly from said hollow housing, the bent over end of said L-shaped projection having a small projecting pin;

said lamp housing having an opening in its first surface thereof for receiving said projecting pin and having a tubular projection on the opposite parallel surface, which hollow tubular projection is inserted in the elongated slot in said hollow housing;

a combination detent and pivot member slidably inserted within said slot in said hollow housing and having a semi-circular groove which cooperates with the inward end of said elongated slot to form a substantially circular opening which embraces said tubular projection in said lamp housing while permitting pivotal movement of the lamp housing.

3. The lamp unit of claim 2 wherein said combination detent and pivot member is provided with a teat projecting in a direction toward said lamp housing;

the adjacent surface of said lamp housing having a plurality of recesses arranged at spaced intervals along an imaginary curved line for snap fittingly receiving said teat to thereby form a detent mechanism for locking said swingably mounted lamp housing in any one of a variety of different angular positions selectable by the operator.

4. A lamp unit comprising a hollow housing;

a battery compartment in said housing containing a portable battery source;

a lamp compartment in said housing and orientation sensitive switch means for selectively electrically coupling said lamp to said battery source when said housing is in a first orientation and for electrically decoupling said lamp from said battery source when said housing is in a second orientation;

means for substantially permanently affixing said housing to a normally movable lid member such as a chest, truck or hatchback lid adapted as a closure for a storage region;

said housing being affixed to the interior surface of said lid whereby said orientation sensitive switch is in the open position when the lid is in its closed position and whereby the orientation sensitive switch is in the closed position when said lid is in its open position;

said lamp housing being provided with a combined front cover and lens member in which the center portions said combined member comprises an integral transparent lens;

the opposite walls of said lens housing being respectively provided with a slot and a square-shaped notch;

said combined front cover and lens member being provided with a first projection along one edge of the periphery of said combined member of insertion into said slot and a second projection arranged on an opposite parallel edge of said combined member of insertion into said notch;

said combined member being provided with a pair of teats each arranged on opposite sides of said second projection and cooperating with a pair of openings provided in the wall of said lamp housing for snap-fittingly receiving said teats to releasably lock the combined member into the operative position within the lens housing.

5. A lamp unit comprising a hollow housing;

a battery compartment in said housing containing a portable battery source;

a lamp compartment in said housing and orientation sensitive switch means for selectively electrically coupling said lamp to said battery source when said housing is in a first orientation and for electrically decoupling said lamp from said battery source when said housing is in a second orientation;

means for substantially permanently affixing said housing to a normally movable lid member such as a chest, truck or hatchback lid adapted as a closure for a storage region;

said housing being affixed to the interior surface of said lid whereby said orientation sensitive switch is in the open position when the lid is in its closed position and whereby the orientation sensitive switch is in the closed position when said lid is in its open position; said affixing means comprising pressure sensitive mounting means comprised of a double-sided pressure sensitive sheet having one surface adhered to the hollow housing and covering said solar cell lens and having the other surface adapted for permanent affixation to the light transmissive member or window of a swingable lid;

said double sided pressure sensitive sheet being light transparent to permit light passing through said window to pass through said double-sided pressure sensitive adhesive sheet and through said solar cell lens to energize said solar cell;

a partially transparent reflective surface being provided on the side of said single-sided pressure sensitive adhesive sheet engaging said window to act as a safety reflector for reflecting light from the head lamps of oncoming cars impinging upon said reflective surface.

6. A lamp unit comprising a hollow housing;

a battery compartment in said housing containing a portable battery source;

a lamp compartment in said housing and orientation sensitive switch means for selectively electrically coupling said lamp to said battery source when said housing is in a first orientation and for electrically decoupling said lamp from said battery source when said housing is in a second orientation;

means for substantially permanently affixing said housing to a normally movable lid member such as a chest, truck or hatchback lid adapted as a closure for a storage region;

said housing being affixed to the interior surface of said lid whereby said orientation sensitive switch is in the open position when the lid is in its closed position and whereby the orientation sensitive switch is in the closed position when said lid is in its open position;

said mounting means comprising a mounting frame adhered to said lid and having a plurality of pairs of resilient embracing arms each having inwardly directly teats near their upper ends;

said lamp unit hollow housing being provided with shallow recesses on opposite side walls of said housing for receiving and seating an associated one of the teats of said resilient embracing arms for releasably holding said lamp unit;

said holding frame being provided with an opening comparable in size with the solar cell lens provided on said hollow housing unit to facilitate the passage of light through said opening and said lens for activating said solar cell.

7. A lamp unit comprising a hollow housing;

a battery compartment in said housing containing a portable battery source;

a lamp compartment in said housing and orientation sensitive switch means for selectively electrically coupling said lamp to said battery source when said housing is in a first orientation and for electrically decoupling said lamp from said battery source when said housing is in a second orientation;

means for substantially permanently affixing said housing to a normally movable lid member such as a chest, truck or hatchback lid adapted as a closure for a storage region;

said housing being affixed to the interior surface of said lid whereby said orientation sensitive switch is in the open position when the lid is in its closed position and whereby the orientation sensitive switch is in the closed position when said lid is in its open position;

said affixing means comprising a transparent sheet substantially covering and affixed to the rear surface of said lamp unit;

said sheet having double-sided adhesive means for adhering respectively to said lamp unit and to the curved surface of said lid;

said transparent sheet having a reflective surface to reflect light striking said surface for safety purposes.

* * * * *